US008490550B2

(12) United States Patent
Crawford et al.

(10) Patent No.: US 8,490,550 B2
(45) Date of Patent: Jul. 23, 2013

(54) ROLLER COASTER WITH ARTICULABLE SEAT BACKS

(75) Inventors: David W. Crawford, Long Beach, CA (US); Thomas Fitzgerald, Altadena, CA (US); Derek Howard, Pasadena, CA (US); David A. Durham, Northridge, CA (US); James H. Shull, Santa Clarita, CA (US)

(73) Assignee: Disney Enterprises, Inc., Burbank, CA (US)

( * ) Notice: Subject to any disclaimer, the term of this patent is extended or adjusted under 35 U.S.C. 154(b) by 233 days.

(21) Appl. No.: 13/190,624

(22) Filed: Jul. 26, 2011

(65) Prior Publication Data

US 2013/0025492 A1 Jan. 31, 2013

(51) Int. Cl.
*A63G 1/00* (2006.01)

(52) U.S. Cl.
USPC ..... 104/63

(58) Field of Classification Search
USPC ..... 104/53, 62–64, 67, 74–76
See application file for complete search history.

(56) References Cited

U.S. PATENT DOCUMENTS

| | | | | |
|---|---|---|---|---|
| 6,405,655 | B1 * | 6/2002 | Clerx et al. | 104/63 |
| 6,523,479 | B1 | 2/2003 | Schilke et al. | |
| 2011/0062755 | A1 | 3/2011 | Gil et al. | |

* cited by examiner

*Primary Examiner* — R. J. McCarry, Jr.
(74) *Attorney, Agent, or Firm* — Marsh Fischmann & Breyfogle LLP; Kent A. Lembke

(57) ABSTRACT

A roller coaster with seats articulated between vertical and reclined positions. The roller coaster includes a track with a load/unload portion and a ride portion. The coaster includes a vehicle with a body supported on the track and a passenger seat positioned in the body mounted for articulation between a first position and a second position. The roller coaster includes a seat positioning mechanism coupled to the passenger seat operating while the vehicle is in the load/unload portion to articulate the seat into the first position and operating, prior to the vehicle traveling into the ride portion of the ride path, to articulate the seat into the second position. The passenger seat includes a seat back that is substantially vertical in the first position and is at an obtuse angle in the second position or horizontal position, such that a passenger has an upward point of view during the ride.

19 Claims, 9 Drawing Sheets

ROLLER COASTER WITH ARTICULABLE SEAT BACKS

BACKGROUND

1. Field of the Description

The present description relates, in general, to amusement park rides including roller coasters, and, more particularly, to a roller coaster with passenger vehicles that are adapted to place passengers, facing in a direction of travel (DOT), in a more horizontal or reclined position such that their point of view (or sight line) is generally upward and not forward in the DOT. In this manner, the passengers cannot see approaching turns and drops adding to the excitement and unpredictability of the ride experience.

2. Relevant Background

Amusement and theme parks are popular worldwide with hundreds of millions of people visiting the parks each year. Park operators continuously seek new designs for rides that attract and continue to entertain park visitors. Further, it is often important to build upon or modify existing rides to provide park visitors with new and exciting experiences without the cost or inconvenience of replacing an existing ride with a completely new ride. For example, it is much more desirable for a park operator to reuse an existing track and support structure than to remove these and build a completely new ride as this places a ride out of use for a longer period of time and, during construction, is more disruptive to nearby attractions.

The roller coaster is one of the more common and popular amusement park rides for providing a thrilling ride experience. In a typical roller coaster, the cars or vehicles are not self powered, but, instead, a coaster train of vehicles supported upon a track is pulled up a ramp or lift hill with a chain or cable to a peak of the coaster track. The potential energy accumulated by the rise in height is transferred to kinetic energy as the vehicles are released or dropped and race down the downward slope. Kinetic energy is then converted back to potential energy as the vehicle train moves up again to a second peak after which it then falls at rapid speed. This cycle is repeated throughout the ride until the vehicle train returns to the loading/unloading station. In some coasters, a launch mechanism is used in the place of a lift hill to set the train of vehicles into motion. In still other coasters that are not powered by gravity, each vehicle or train of vehicles is self-powered. In most roller coasters, the rider or passenger is seated in an upright position with their back near vertical and facing the direction of travel (DOT) of the vehicle train along a supporting track. In other cases, a vehicle or the entire seat assembly may be rotated or repositioned after loading to place the passenger in a forward leaning/inclined position to simulate flying.

While thrilling to new riders, there is often a desire that older roller coasters be modified or updated. For example, many roller coasters are 30 years or more old, and the ride experience may not be as thrilling as when the ride was first built. Some of the loss in ride enjoyment is because the coaster riders have ridden the ride so many times that they have become very familiar with the coaster's ride experience. The ride does not change so that riders can almost memorize each drop and curve and the ride may become predictable and less thrilling. Another reason an older roller coaster may experience a drop in rider numbers is that new roller coasters are being built with new design tools that allow the coasters to provide more thrilling rides including more extreme curves, drops, and vehicle rotations about a track.

As a result, many park operators are looking for new roller coaster designs that provide unique and different ride experiences. Preferably, such roller coaster designs would be useful in modifying or retrofitting existing roller coasters such that the existing track and associated structure could be used in the new ride. Further, it is desirable that the ride designs are configured for loading/unloading of passengers in conventional ways, such as with the riders being seated in a generally upright position.

SUMMARY

The present invention addresses the above problems by providing a roller coaster (or coaster-type ride system) in which passenger seats in the coaster's vehicles are adapted to be articulated so as to move between a load/unload position to a ride position, which still faces forward into the direction of travel (DOT) of the vehicle but with a much different point of view (POV). More specifically, the passenger seats may have an articulable seat back that is moved by a seat positioning mechanism (or seat actuator) between a first position that may be near vertical or upright for use in loading/unloading of passengers and a second position that may be more horizontal or reclined for use in placing the passengers in a ride orientation. For example, the second or ride position of the seat back may be an obtuse angle measured from horizontal that is between 120 and 180 degrees such as 140 to 170 degrees or the like. Use of such a ride position for the seat back causes each passenger to have a point of view that is substantially upward rather than along the (or parallel to the) DOT of the vehicle. Placing the seat back in a reclined or more horizontal position significantly changes the ride experience as the passengers cannot see upcoming turns and elevation changes in the track and, instead, view differing theme or structural features than when in a conventional upright position.

More particularly, a roller coaster is provided in which passenger seats are articulable between at least two positions (e.g., a load position in which the seat back is vertical or nearly so and a ride position in which the seat back is reclined to nearer horizontal such that the passenger is looking upward during the ride). The roller coaster includes a track defining a ride path with a load/unload portion and a ride portion. The coaster also includes a vehicle with a body supported on the track and a passenger seat positioned in the body and mounted for articulation between a first position and a second position.

Significantly, the roller coaster also includes a seat positioning mechanism coupled to the passenger seat. This mechanism first operates while the vehicle is in the load/unload portion of the ride path to articulate the seat into the first position and second operates, prior to the vehicle traveling into the ride portion of the ride path, to articulate the seat into the second position. The passenger seat includes a seat back for supporting a passenger's back, and, during normal operation of the roller coaster, the seat back is substantially vertical relative to horizontal in the first position (e.g., at 90 to 110 degrees or the like as measured from horizontal from the front of the vehicle body) and is at an obtuse angle relative to horizontal in the second position.

In some embodiments, the seat back is positioned with a passenger-receiving side facing a forward portion of the vehicle body, whereby a passenger has a point of view along a direction of travel of the vehicle when the seat back is in the first position. In such embodiments, the ride portion may make up at least 90 percent of the length of the track, and the vehicle is typically supported above the track for at least one half of the ride portion, such that a passenger positioned in the passenger seat has a line of sight that is generally upward when the vehicle is supported above the track (e.g., has their view blocked along the direction of travel of the vehicle along the track).

In some cases, the seat back is positioned at an angle selected from the range of 90 to 110 degrees when in the first position and at an angle selected from the range of 120 to 180 degrees when in the second position. In some of these cases, the angle selected for the second position of the seat back is between about 135 and 170 degrees, and a passenger seated in the passenger seat has a line of sight that is upward and is at least partially blocked along a direction of travel of the vehicle.

In many embodiments of the roller coaster, the passenger seat further includes a seat pan, and the seat pan is articulated concurrently between first and second positions associated with the first and second positions of the seat back. For example, the seat pan may be slid horizontally during the articulation of the passenger seat or may be pivoted a different amount than the seat back during the articulation of the passenger seat (e.g., as the seat back is rotated 45 to 60 degrees backward from the upright first position, the seat pan may be rotated only 30 to 45 degrees (or some other useful percentage/fraction of the seat back rotation magnitude)).

The seat positioning mechanism may take a number of forms to achieve seat rotation between the first and second positions. For example, the coaster may include a cam rail assembly along the track in the load/unload portion of the ride path. Then, the seat positioning mechanism may include a cam assembly contacting a contact surface of the cam rail assembly and translating the contacting to articulation of the seat back via a linkage assembly coupled to the seat back. In other cases, the seat positioning mechanism may include an electric motor or a linear actuator operated to articulate the seat back between the first and second positions while the vehicle is positioned in the load/unload portion of the ride path.

DETAILED DESCRIPTION

Figure 1:
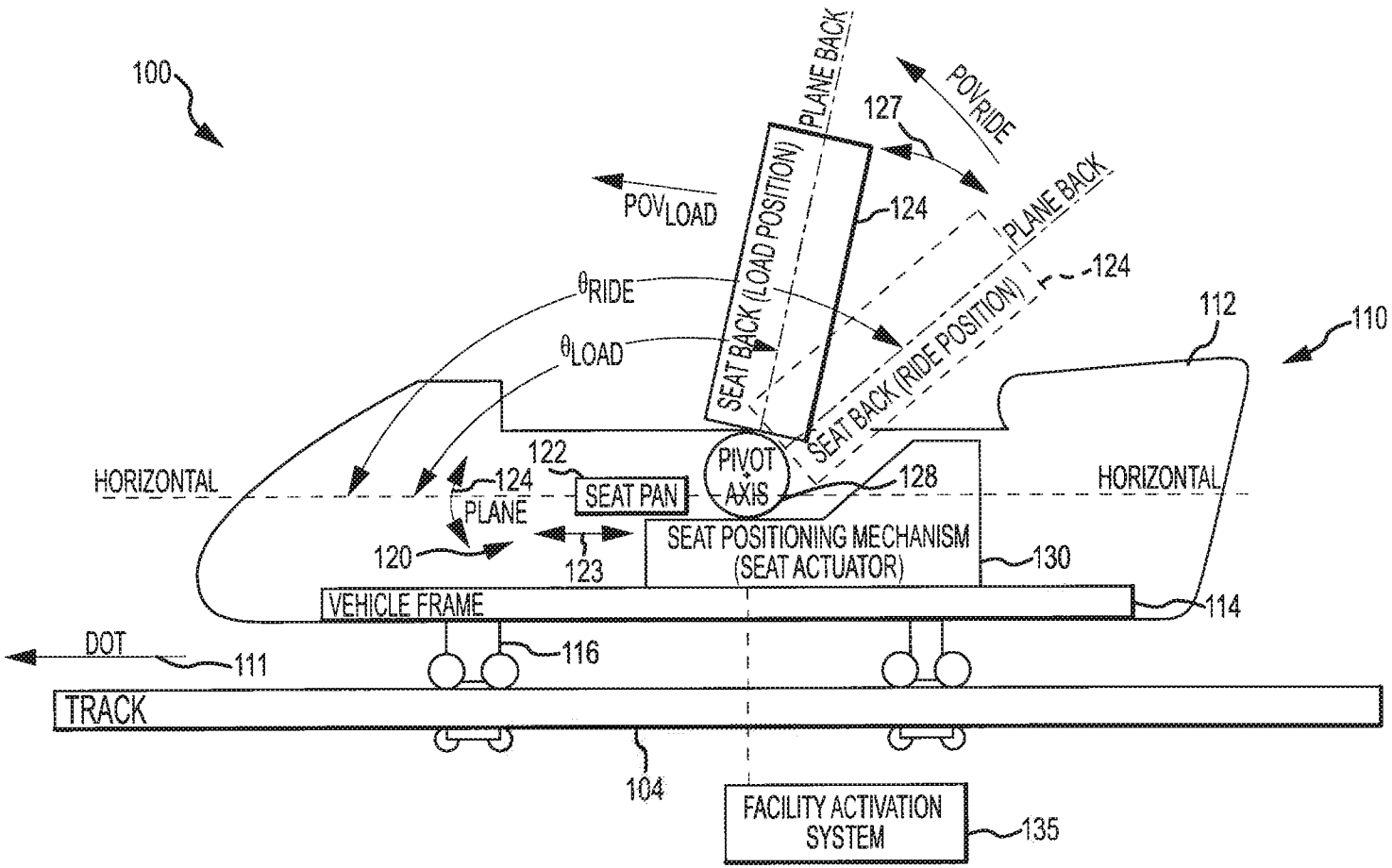
FIG. 1 is a function block or schematic illustration of a portion of roller coaster or ride system according to the present description showing a passenger seat that has a seat back (at least) that is articulable between two positions such as a vertical (or near vertical) load position and a more horizontal ride position.

The following description is generally directed to an amusement park ride such as a roller coaster that can be used with existing tracks to provide a new ride experience with modifications to provide passenger seats that can be selectively positioned in at least two positions: a first position in which the seat back is substantially upright or vertical for loading and a second position in which the seat back is more horizontal or reclined for use during the ride (e.g., as the vehicle travels in the ride portions of the track). Briefly, each vehicle includes a seat positioning mechanism that operates to move at least the seat back from the first position to the second position after the vehicle is loaded in the loading/unloading station. The vehicle then travels along the ride portion of the track with the seat back reclined into the ride position (e.g., an obtuse angle such as 165 degrees or the like as measured from horizontal), and, when or as the vehicle returns to the loading/unloading station, the seat positioning mechanism (or seat actuator) operates to return the seat back to the first position for vehicle unloading and loading. In some cases, the seat pan is also articulated either with the seat back (e.g., the seat back and pan are pivoted as a unit) or independently (e.g., the seat pan is rotated through a different angle or may be slid forward as the seat back is reclined to provide more rider comfort).

By leaning the seat backs from vertical to an obtuse angle, a completely new ride experience can he achieved in a roller coaster even using an existing or a traditional rollercoaster track. In other words, an existing roller coaster may be modified based on the teaching provided herein to provide a roller coaster that provides a new ride experience. The passenger seats are actuated between at least two positions: (1) a load/unload position and (2) a ride position(s). In the load/unload position, the seat back is in a "normal" position such as substantially vertical (e.g., 90 to 110 degrees or the like from horizontal), which allows passengers to load and unload the vehicle comfortably either in the station or during an evacuation. In the ride position, though, the seat back would be leaned or rotated backwards (e.g., away from the "front" of the vehicle and its direction of travel (DOT)) to a more horizontal position such as to an obtuse angle of 120 to 180 degrees as measured from horizontal.

In the ride position, the passenger's sightlines and point of view (POV) are substantially blocked in the vehicle's DOT, and the passenger can no longer see what is coming as the vehicle moves through the ride portions of the track or see when the track is going to turn or drop/rise. Such unexpected moves of the vehicle increase the thrill, excitement, and unpredictability of the ride experience. The passenger's POV is largely directed upward (in contrast to a passenger seated in a conventional upright/vertical position) such that parts of a roller coaster ride that would not be seen by a conventional seat arrangement are easily observed. The thrill, excitement, and unpredictability of the experience are significantly increased as objects cross quickly in and out of the passenger's field of view. For example, overhead rockwork may open into expansive caverns in a mountain-themed ride and then quickly return to close-in rockwork. This serves to enhance the sense of speed and excitement as the riders are unaware of what lies ahead along the track.

A roller coaster was tested by the inventors that included a passenger seat with a seat back positioned in a reclined or "horizontal" position. This test, on an old and existing coaster, showed that the experience provided was fun, unique, and substantially different than that provide by a vertical seat back on the exact same track. A number of experiential, operational, and marketing benefits have been identified by the inventors for this type of roller coaster ride. The ride provides an articulated seat that allows for easy and familiar load/unload of the vehicle in the station or during evacuation, as well as delivering a new and unique ride experience to the passengers. The experience is more disorienting and thrilling because the passenger does not know where he is or what is going to happen next. There are no fixed visualization points, and this even proved true for attraction-operator passengers that know the ride extremely well (e.g., their comments were along the vein of "feels like I'm riding this coaster for the first time again"). Not being able to see the track or upcoming path through the sets prevents the passenger from preparing themselves and/or expecting what is coming next.

The articulable seat coasters heighten the sense of speed especially in low roof or tunnel areas of the ride. This allows for slower coasters and shorter tracks to be used while still delivering on demands for high levels of rider thrill. The coasters provide passengers with new and interesting view points of the show and ride environment. Test passengers commented on seeing things in the old and existing coaster attraction that they had never seen before even though they had ridden the original coaster many, many times. The passenger POV and perspective on the ride set/environment (or "show") was new and exciting and set pieces/structure may appear larger from the reclined perspective. The lift hill feels like a vertical lift since the combination of vehicle body/frame tilt and seat back horizontal position tilts the passenger even farther back, and this was found by the passengers to be fun and interesting. The roller coaster provides fun transitions between tight tunnels and low ceiling portions to portions of the track in which the nearby structure is more wide open and may have higher ceiling rooms or be outdoors. Overhangs or "bridges" were very surprising, exciting, and/or frightening to the test coaster passengers as they could not see them approaching, and twists, turns, and drops had a heightened sense of thrill since the rider was unprepared for the dynamic experience.

FIG. 1 illustrates, in a schematic or functional block form, a ride system or roller coaster 100 that may be used to implement some of the features described herein. For ease of explanation, only a single passenger vehicle 110 is shown but the roller coaster 100 typically would include a train of such vehicles 110, and only a portion of a support or ride track 104 is shown with the understanding that a continuous loop of such track 104 would be provided as is common in coaster-type rides so as to support the vehicle 110 in ride and load/unload portions of the track or its track-defined ride path. Also, passengers are not shown in the vehicle 110 but it will be understood that the vehicle 110 is adapted to seat one, two, or more passengers in its passenger seats 120 and to provide each of these passengers with a point of view (POV) or line of sight by moving the seat back 126 between at least two positions.

As shown, the roller coaster 100 includes a passenger-carrying vehicle 110 with a body 112 that engages a track 104 in a rolling manner with wheel/bogie assemblies 116 extending outward from the bottom of the body 112. In this manner, the vehicle body 110 is supported above the track 104 and during operation of the roller coaster 100 rolls along the track 104 in a DOT shown by arrow 111. The body 110 includes a frame 114 that supports a passenger seat 120 adapted for receiving (or seating) a passenger (not shown in FIG. 1) and seat positioning mechanism (or seat actuator) 130 that is adapted for articulating the passenger seat 120 between two or more positions (with two shown in FIG. 1 for simplicity's sake).

The passenger seat 120 includes a seat pan 122 for receiving a passenger's thighs and buttocks and a seat back 126 for supporting a passenger's back and, typically, head (such as with a head rest (not shown separately)). The vehicle 110 further includes the seat positioning mechanism 130 that is attached to the frame 114 and interconnected with the seat 120 to pivot the seat 120 about a pivot axis 128 (that may pass through a pivot pin or axle adjoining the pan 122 and back 126). The positioning mechanism 130 may take a number of forms to perform this actuation of the seat 110 with several examples explained below with reference to FIGS. 4-10.

A facility activation system 135 may be linked (physically such as a cam rail or power bus to power an actuator or via wireless communication signals) to the seat positioning mechanism/seat actuator 130. Such an activation system or device 135 would typically be included in any implementation or embodiment of a roller coaster in a station area to activate the seat rotation with the seat positioning mechanism 130 provided in each vehicle 110. For example, the activation system 135 may take the form of a cam rail for a cam version of the seat positioning mechanism 130. In other cases, the activation system 135 may take the form of a power distribution system (e.g., bus bars or the like) to provide power to the seat positioning mechanism 130 when the mechanism 130 takes the form of a motor or linear actuator (or a wireless signal may be provided if power were provided for such a motor/actuator on the vehicle 110). As part of the positioning mechanism 130 or as a separate component, the vehicle 110 may have either a cam or a "power pickup system" to route electrical power to these components. Numerous arrangements for such power distribution/activation by system 135 may be provided with many configured to provide a conductor-to-conductor contact for a time period associated with the vehicle being in the station of the roller coaster 100.

In all embodiments, the seat positioning mechanism 130 is configured to pivot as shown with arrow 127 the seat back 126 between a load position and a ride position. Specifically, a plane, $Plane_{Back}$, extending through the seat back 126 is pivoted about a pivot axis 128 by the positioning mechanism 130 such that the plane, $Plane_{Back}$, is moved from a load/unload position in which the back position angle, $\theta_{Load}$, is changed from nearly vertical (e.g., 90 to 110 degrees or the like as measured from horizontal to the plane, $Plane_{Back}$) to a more horizontal position angle, $\theta_{Ride}$ (e.g., 120 to 180 degrees or an obtuse angle selected from the range of about 140 to 170 degrees such as about 165 degrees or the like).

As a result of this articulation or reclining, a passenger seated in the passenger seat 120 would have their POV moved to parallel or nearly parallel to the DOT 111 of the vehicle 110 to a more vertical POV (e.g., a line of sight of 0 to about 60 degrees forward of vertical) that would be retained through the ride portion of the track 104. The passenger would still he facing the DOT 111 but with a POV that is transverse to the DOT 111 such that at least a portion of the view along the DOT 111 is blocked.

The actuation mechanism 130 may retain the seat pan 122 in the same position throughout operation of the roller coaster 100. However, in some embodiments, as shown with arrow 124 the seat pan 122 is rotated with the seat back 126 or separately between a load/unload position to a ride position. For example, the angle measured between a plane, $Plane_{Pan}$, passing through the seat pan 122 and horizontal may begin at near zero (e.g., 0 to 15 degrees) and be changed to the same amount as the seat back or some smaller amount to provide more comfort to the passenger.

In any case, the seat 120 is provided or positioned in the vehicle 110 such that the passengers are arranged "feet first" rather than head first and are facing generally forward or in the DOT 111. Further, while some embodiments may retain the passengers body in a generally 90 degree configuration (legs relative to back), many embodiments involve altering or changing the passenger's body orientation from a load position to a ride position (and back again for unloading). For example, the passenger (and seat 120) may initially be arranged by positioning mechanism 130 to have the seat back 126 at about 90 degrees from the seat pan 122 (as measured between the two planes) in the load/unload position and then to have the seat back 126 at a greater angle (such as 120 to 180 degrees) from the seat pan 122 in the ride position.

In this way, the seat back 126 may be rotated 127 through 15 to 90 degrees between the load and ride positions (e.g., rotation 127 is typically at least 15 degrees from the load position to block vision along the DOT 111, with the understanding that a natural resting position for the human eye is about 15 degrees below horizontal), and the pan 122 may be rotated 124 in a similar manner (when the two seat components are moved as a single unit about axis 128) or a smaller amount (e.g., 30 degrees when the back 126 is rotated through 45 degrees or the like (i.e., the back is moved more than the pan typically by at least about 10 to 15 degrees) when the pan 122 is moved independently from but concurrently with back 126). In other embodiments, though, the positioning mechanism 130 is adapted to slide 123 the seat pan 122 as the seat back 126 is rotated 127 to provide better comfort to the passenger or for operational/design reasons. For example, the seat pan 122 may be slid forward toward the front of the vehicle body 112 when the seat back 126 is rotated from the load/unload position to the ride position (and vice versa).

In general, the load/unload portion of the track will be a relatively small fraction or portion of the overall length of the track when compared with the ride portion of the track. Hence, the passenger seat will he in the ride position with the seat back having its plane, $Plane_{Back}$, at the obtuse position angle, $\theta_{Load}$, for a majority of the ride operation such as 90 to 95 percent of ride (or 5 to 10 percent or less being used for the load/unload portion, which will typically correspond with the station for the coaster 100).

Figure 2:
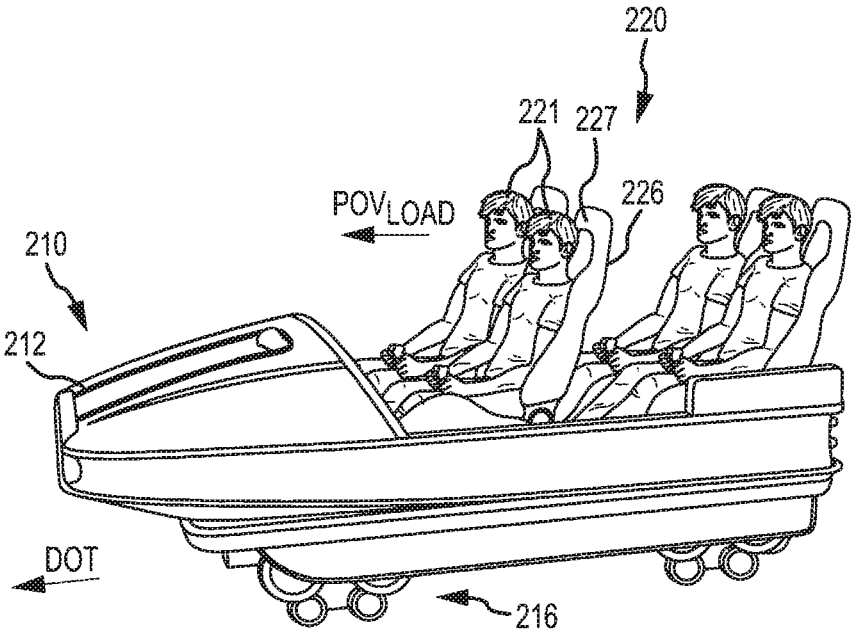
FIGS. 2 and 3 illustrate front perspective views of an exemplary coaster vehicle adapted according to the present description with passenger seats positioned first in a loading (unloading) position (as shown in FIG. 2) with a seat back in an upright (vertical or near-vertical orientation) and second in a ride position (as shown in FIG. 3) with the seat back reclined or pivoted to a horizontal or more horizontal position (e.g., at an obtuse angle measured from horizontal of 110 to 180 degrees with some embodiments using seat back angular positions of 145 to 165 degrees)

FIG. 2 illustrates a vehicle 210 that may be used in a roller coaster of the present invention such as the ride 100 of FIG. 1. In FIG. 2, the vehicle 210 is shown to be in the station or along a load/unload section of a track (not shown but used to support the vehicle 210 from below via wheel/bogie assembly 216). The vehicle 210 includes a body 212 and a number of passenger seats 220 each adapted with a seat pan (not visible in FIG. 2) and a seat back 226. The passenger seats 220 are each adapted to support a passenger 221 with the passenger's back supported by a front side/surface 227 of the seat back 226. In the station as shown, a seat actuation mechanism is used to position and lock the seat back 226 in a generally upright or vertical position such that the front side 227 is at an angle of about 90 to 110 degrees relative to horizontal such that the passenger's back is generally upright and the passenger 220 has a POV at loading that is parallel to or generally along the DOT of the vehicle 210 along the track or ride path.

Figure 3:
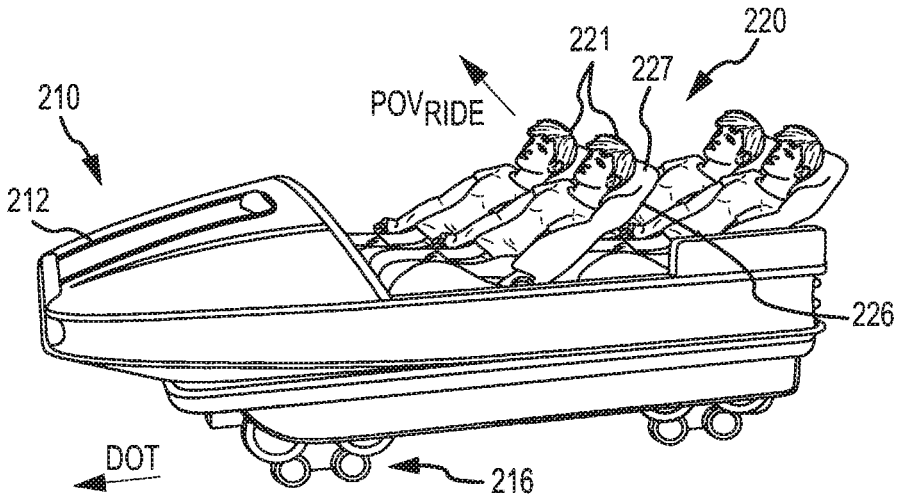

FIG. 3 illustrates the vehicle 210 as it is exiting or entering the ride portion or segment of the track of a roller coaster (such as coaster 100). As shown, the seat actuation mechanism has operated to articulate or pivot the seat back 227 to a ride position. In the ride position, the passengers 221 have their backs' reclined with the seat fronts 227 to an obtuse and more horizontal position angle such as 120 to 180 degrees from horizontal with about 145 to 165 degrees being shown for the seat back 226. In this reclined position of the seat back 226, the passenger 221 has a POV during the ride portion that is upward such that they are essentially looking up as the POV is transverse to the DOT and a view along the DOT is typically fully or at least partially blocked for the passengers 221.

Figure 4:
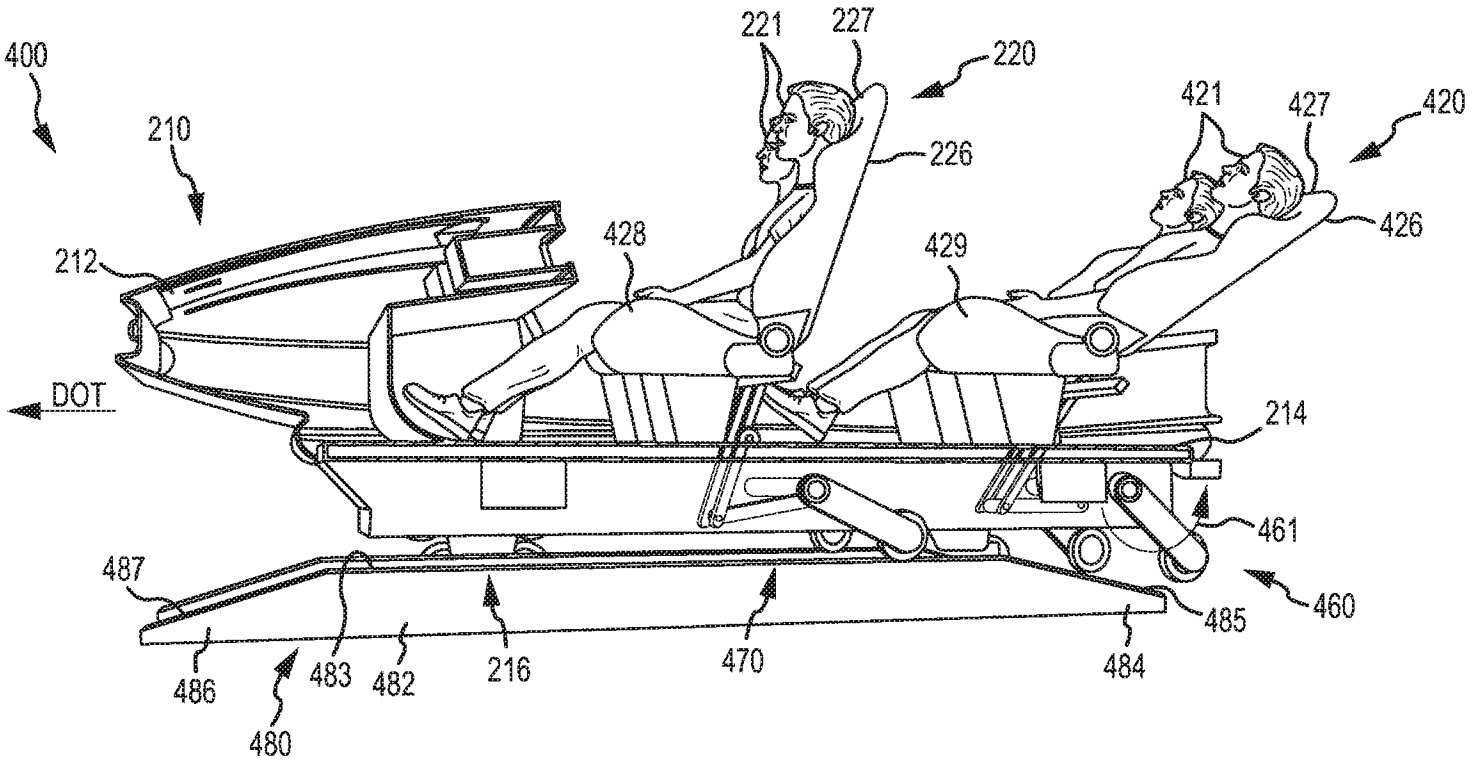
FIG. 4 illustrates a portion of roller coaster or ride system showing a sectional side view of the coaster or passenger vehicle of FIGS. 2 and 3 as the vehicle enters a load/unload section or portion of the roller coaster with the forward passenger seats moved up into load/unload positions and the rear passenger seats still in ride positions with their seat backs reclined.

While a number of differing seat actuation mechanisms may be utilized to articulate the seat (e.g., recline the seat back), it may be useful to provide more detailed descriptions of several devices or assemblies that may be provided in a vehicle to achieve the articulable seat described herein. FIG. 4 illustrates a portion of a roller coaster 400 that includes the vehicle 210 while it is entering a load/unload station or portion of a ride or track. FIG. 4 provides a sectional view of the vehicle to illustrate use of cam-based actuation to provide articulation of seat backs 226.

With cam-based seat actuation in the coaster 400, seat rotation is provided by off-board static or an actuated station rail. As shown, the coaster 400 includes a passenger seat 220 with a seat back 226 and a seat pan 428 in which a passenger 221 is seated. The seat 220 is shown in a load/unload position with the cam-based seat actuation mechanism 470 operated to lock the seat back 226 in the upright or near vertical orientation. The coaster 400 also includes another passenger seat 420 further back in the vehicle body 212, and both seats 220, 420 are supported on the frame 214 of the vehicle 210. A passenger 421 is supported on the front side 427 of the seat back 426 and by seat pan 429. The cam-based seat actuation mechanism 460 interconnected with seat 420 is about to operate as shown with arrow 461 to move the seat back 426 to the load/unload or upright position but has not yet contacted a cam rail assembly 480 such that the seat back 426 is still in the full reclined or horizontal ride position. As shown, the seat pan 429 is not rotated with the seat back 426 in this particular embodiment.

As shown, the coaster 400 includes a station cam rail assembly 480 that includes a central cam section 482 with an upper contact surface(s) 483 for contacting cams/rollers of seat actuation mechanisms 460 and 470 and causing these mechanisms 460, 470 to articulate the seat backs 426, 226 into the load/unload position. The rail assembly 480 also includes a leading contact section 484 with a sloped contact surface 485 for controlling the rate at which the actuation mechanisms 460, 470 move the seat backs 426, 226 from a ride position up into a load/unload position (e.g., at what rate the rotation of the input cam is translated by a linkage assembly into rotation of the seat backs 426, 226). The rail assembly 480 further includes a trailing contact section 486 with a sloped contact surface 487 for controlling the rate at which the actuation mechanisms 460, 470 move the seat backs 426, 226 from the load/unload positions down to a ride position (e.g., at what rate the rotation of the input cam is translated by the linkage assembly into rotation/reclining of the seat backs 426, 226).

Figure 5:
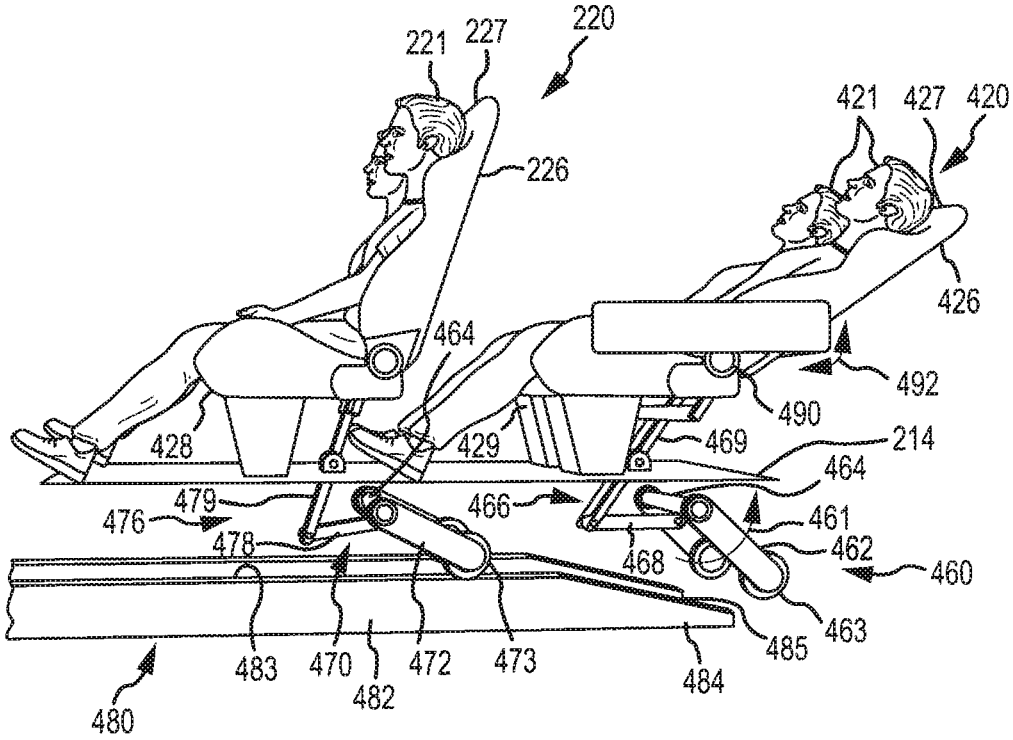
FIG. 5 illustrates in more detail the seat positioning mechanisms of FIG. 4, which each include a cam-based actuator to selectively position the seat back.

FIG. 5 shows the cam-based actuation of the seats 220, 420 in more detail. As shown, the actuation mechanism 460 includes rollers/cams 463 for contacting the cam rail assembly 480 on surface 485 to initiate rotation 461 of cam arm 462. This rotation 461 of cam aim 462 causes rigidly attached shaft/axle 464 to rotate about its longitudinal axis which causes linkage assembly 466 to translate via arms 468, 469 the rotation 461 into rotation or pivoting 492 of the seat back 426 of seat 420 about rotation axis 490 (e.g., a pin/shaft at the base of the seat back 426 such as where or near where the seat back 426 mates with seat pan 429, which is stationary in this example of coaster 400). As shown, the seat back 426 will be rotated 492 to move it from a ride position and obtuse angle (e.g., 150 to 165 degrees) to a load/unload position and near right angle (e,g., 90 to 110 degrees such that the seat back 426 is rotated/pivoted 492 about pivot axis 490 through 40 to 75 degrees or the like).

Likewise, the actuation mechanism 470 includes rollers/cams 473 that are abutting or contacting to roll upon cam rail surface 483 of the central cam section 482 to retain the seat back 226 in the load/unload position (or in a generally upright/vertical orientation). The cam wheels 743 are pivotally supported on ends of cam arms 472, which are rigidly bound at the other end to shaft/axle 474 so that the shaft 474 rotates with arm 472. This causes interconnected arms 478, 479 of linkage assembly 476 to translate rotation of cam arm 472 to rotation of the seat back 226 to the upright load/unload position shown in FIG. 5 (from that shown for seat back 426).

As shown in FIGS. 4 and 5, cam-based seat actuation can be provided effectively with a cam rail 480 that forces cam arms 462, 472 to rotate (e.g., CCW) 461. This causes the linkage assemblies 466, 476 of the actuation mechanisms 460, 470 to rotate the seat backs 426, 226 into a vertical position. This may also be accomplished in other embodiments through the use of an actuator (e.g., a pneumatic, an electric, a hydraulic, or other actuator) that moved this linkage 466, 476 or was connected directly to the seat structure (though this would require a power source that was located onboard the vehicle 210 or became connected to the vehicle 210 while the vehicle 210 was in the station for loading/unloading).

Figure 6:
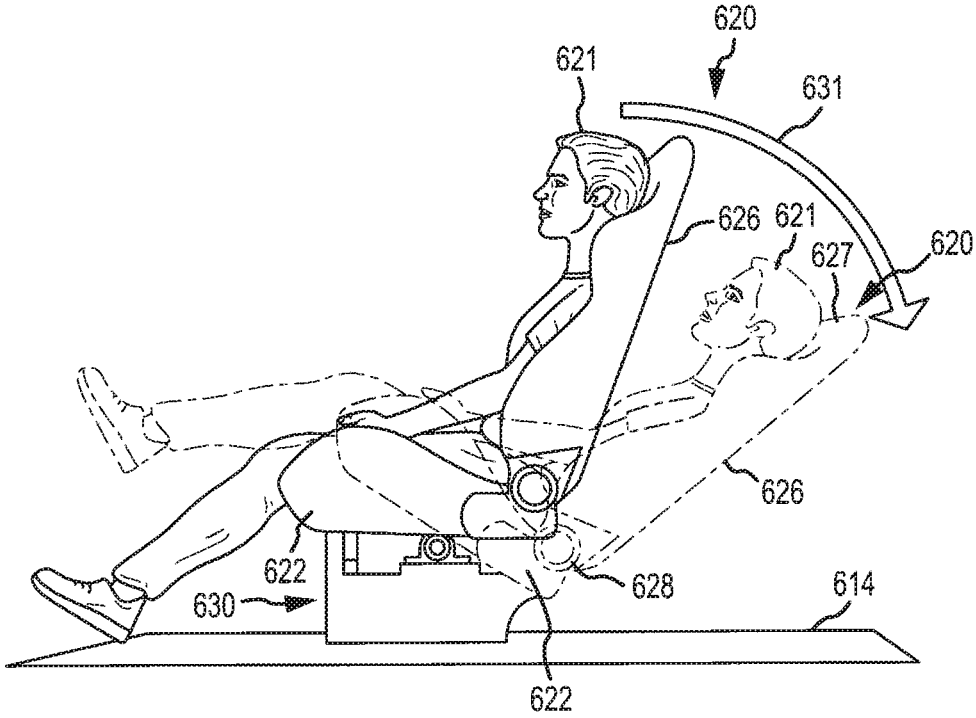
FIG. 6 is a side view of a passenger seat combined with an actuator to provide an articulable seat back (and seat pan, in this example) for use in roller coaster vehicles or the like, and the passenger seat is shown in the load/unload position and also in the ride or reclined position.

FIG. 6 illustrates another exemplary passenger seat 620 that may be articulated by a seat positioning mechanism 630 that is mounted upon a frame 614 of a vehicle body (e.g., a roller coaster car or vehicle). The passenger seat 620 is shown (with solid lines) in a first or load/unload position and (with dashed/ghost lines) in a second or ride position. The passenger seat 620 is shown to include a seat pan 622 along with a seat back 626. The passenger seat 620 such as the pan 622 and back 626 are articulable by the positioning mechanism 630, e.g., when the vehicle carrying the seat 620 is in a load/unload station or along a load/unload portion of the ride path or ride track.

In contrast to the seat 220, the passenger seat 620 is configured such that the seat pan 622 and seat back 626 are rotated together as a unit. For example, the positioning mechanism 630 may act to pivot the seat about the pivot shaft/pin 628 (or pivot axis of the seat 620) as shown with arrow 631 from the first position to the second, reclined position. During such rotation, the seat back 626 and the seat pan 622 are rotated 631 together about pin 628 through a same rotation/pivoting angle (e.g., 10 to 90 degrees of rotation or the like). In this case, the passenger 621 has their legs moved with the pan 622 as well as their back and head with seat hack 626 (to provide a differing POV or line of sight, as discussed above).

The seat positioning mechanism 630 may take many forms to provide seat rotation by an onboard actuator or motor. The mechanism 630 may work on the seat 620 directly or through linkage(s). The mechanism 630 may include an actuator to pivot the seat back 626 and/or the seat pan 622, and the actuator may be electric, pneumatic, hydraulic, or the like. This actuator may be powered by an onboard power source (e.g., a battery, an accumulator tank, or the like) or the actuator may be powered via a connection to an off-board power source while the vehicle carrying the seat 620 and mechanism 630 are in a load/unload station (where pivoting 631 occurs). Hard stops may be used to provide positive positioning of the seat pan 622 and seat back 626 in the two positions shown.

Figure 7:
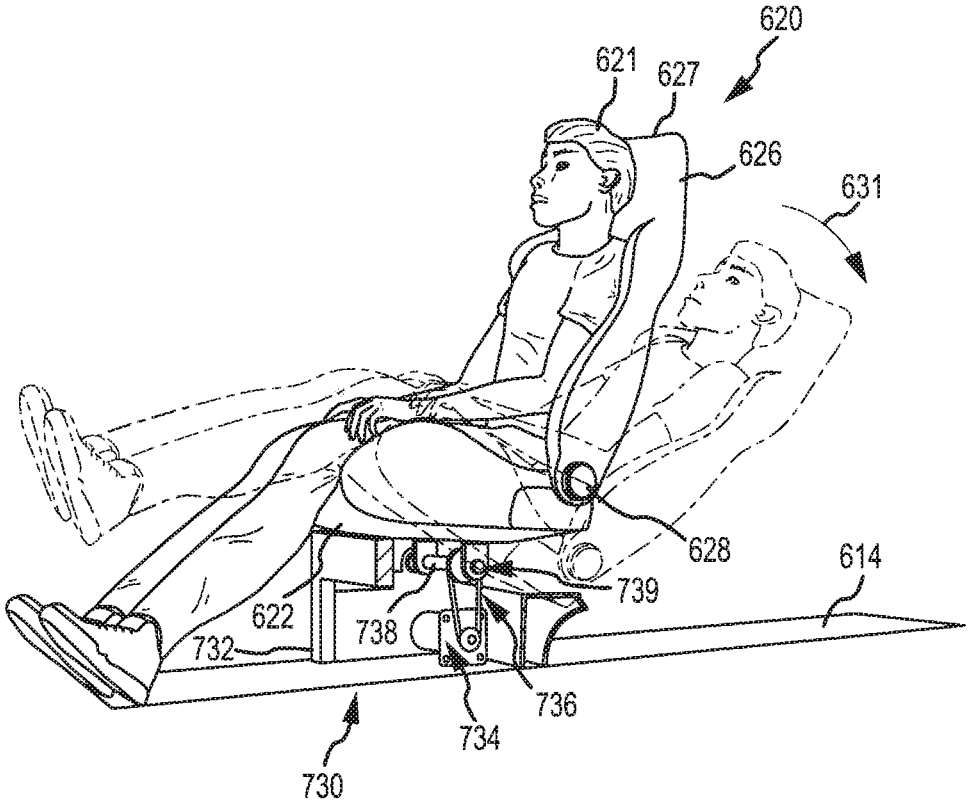
FIG. 7 is a perspective side view of the passenger seat of FIG. 6 with cutaways used to show an embodiment of the actuator that includes an electric motor to control actuation of the articulable passenger seat.
Figure 8:
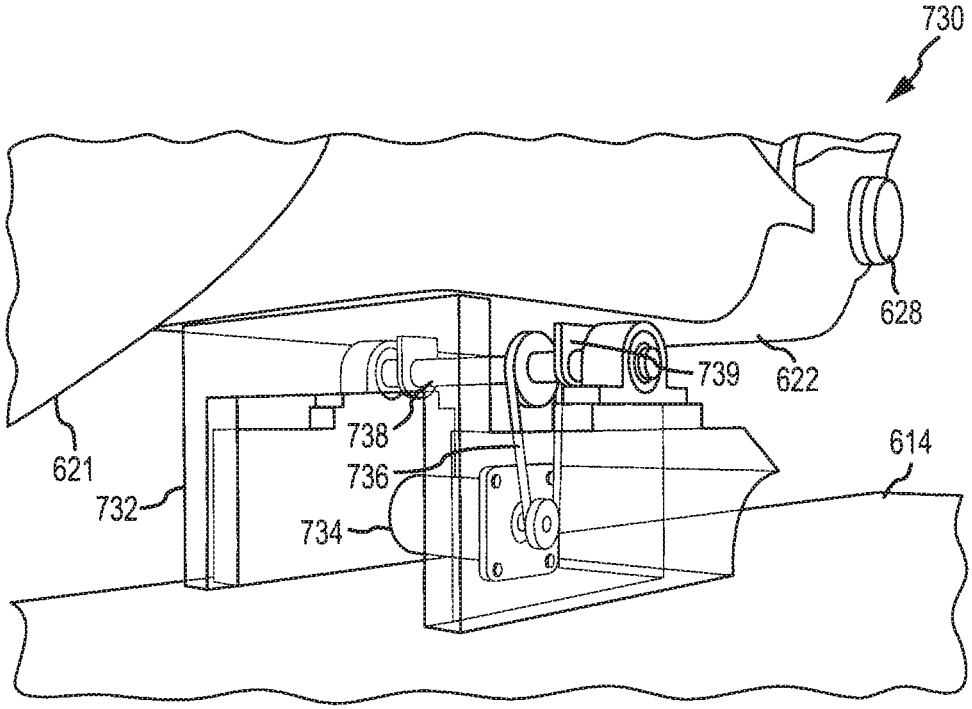
FIG. 8 provides a more detailed view of the actuator used in the implementation shown in FIG. 7.

FIG. 7 illustrates the seat 620 articulated by an implementation of a positioning mechanism 730 that uses a motor to provide seat rotation 631, and FIG. 8 illustrates the positioning mechanism 730 and its components in more detail. As shown by a cut-away view in FIG. 7 and ghosted view in FIG. 8, the positioning mechanism 730 includes a support structure 732 attached to the frame 614. The support structure 732 supports an electric motor 734 that is selectively operated by a controller (not shown) such as via wireless signals upon entering a station to move a belt/chain 736. The belt/chain 736 is connected to a drive shaft 738, which is rotated an amount corresponding to a desired amount of angular pivoting 631 for the seat back 626 and seat pan 622. In this illustration, a pair of pivot elements 739 are rigidly coupled both to the drive shaft 738 and to the bottom of the seat pan 622 so as to pivot 631 the seat pan 622 and interconnected seat back 626 about axis/shaft 628 in response to rotation of the drive shaft 738 by the drive motor 734 via belt/chain 736.

Figure 9:
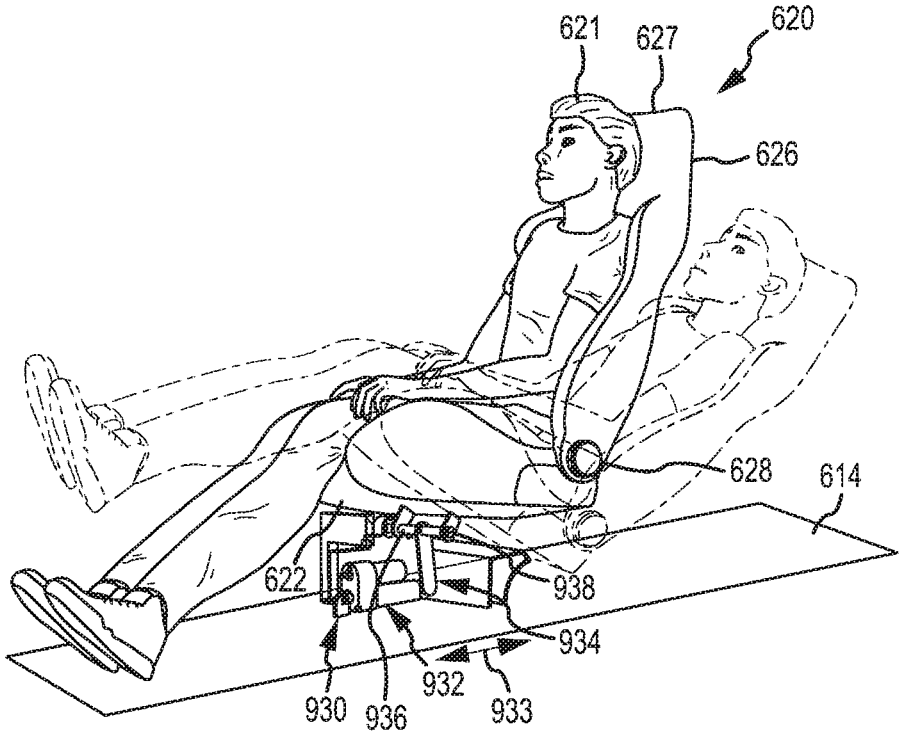
FIG. 9 is a perspective side view of the passenger seat of FIG. 6 with cutaways used to show an embodiment of the actuator that includes a linear actuator to control actuation of the articulable passenger seat.
Figure 10:
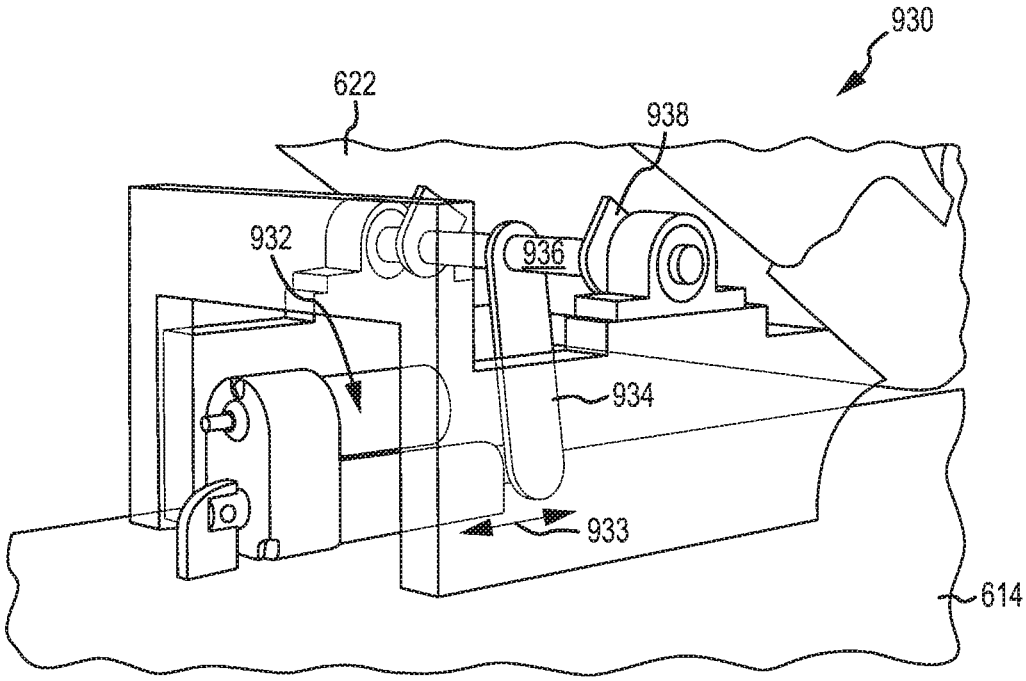
FIG. 10 provides a more detailed view of the actuator used in the implementation shown in FIG. 9.

FIG. 9 illustrates the seat 620 articulated by an implementation of a positioning mechanism 930 that uses a linear actuator to provide seat rotation 631, and FIG. 10 illustrates the positioning mechanism 930 and its components in more detail. As shown, the positioning mechanism 930 includes a linear actuator 932 mounted on the vehicle frame 614 (e.g., an onboard or vehicle-mounted linear actuator). In response to control signals from a station-based controller or other control device (not shown), the linear actuator 932 drives 933 a crank arm 934, which is coupled to a drive shaft 936. As a result of the driving and movement of crank arm 934, the drive shaft 936 is rotated about its longitudinal axis on a seat/positioning mechanism support structure or frame. As with mechanism 730, a pair of pivot elements 938 are affixed to the drive shaft 936 and to the bottom of the seat pan 622 such that when the linear actuator 933 causes the drive shaft 936 to rotate the pivots 938 cause the seat pan 622 and interconnected seat back 626 to pivot 631 about pin/shaft 628.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

As can be appreciated from the foregoing, a roller coaster is taught that includes an articulable seat back. The coaster includes a passenger-carrying vehicle that rides on a structural track, which is positioned below the vehicle to support and guide the vehicle along a fixed and continuous path loop on a gravity or powered-coaster type of ride experience. The coaster also includes a seat positioning (articulation) system that can operate to orient the passenger and the corresponding seat back from a fixed, substantially vertical position (when the vehicle is in the load/unload portion of the track) to a fixed, substantially horizontal position (when the vehicle is moving under gravity or power through the ride portion of the track) so as to significantly change each passenger's perspective or POV. The coaster may also include an immersive show environment/presentation or adjacent show structure along the ride portions of the track that is arranged and/or configured so as to be viewable by the passengers in the vehicle when they are in the ride or reclined position.

In some embodiments, the seat articulation system rotates the entire passenger seat (seat pan and seat back together). In others, the system only rotates the back panel or seat back portion and/or the seat pan is rotated or slid between first and second positions (e.g., independently). The seat back position angle (as measured between a plane extending through the seat back and horizontal from the DOT or front of the vehicle) may be about 90 to 100 degrees in the first or load position and may be about 120 to 180 degrees (e.g., 145 to 170 degrees) in the second or ride position.

The seat articulation system may include an actuator and a linkage assembly that work in conjunction to move the seat back (and seat pan in some cases) between the first and second positions and then locks the seat back into place. When needed, power for the actuator may be provided onboard (e.g., a battery, an accumulator, or the like) or via a temporary connection to an off-board source while in the station. The seat articulation system may include an electric motor that moves the seat back (and seat pan in some cases) between the first and second (or more) positions and locks it in place. The seat articulation system may instead be made up of a completely passive linkage arrangement that is connected to the passenger seat and rotated by a separate assembly located off-board that contacts the linkage assembly when the vehicle travels through the station. This may be a passive or actuated cam rail or station-based actuator. Hard stops may be provided in the passenger seat at the two different seat positions/orientations.

We claim:

1. A roller coaster, comprising:

a track defining a ride path with a load/unload portion and a ride portion;

a vehicle with a body supported on the track;

a passenger seat positioned in the body and mounted for articulation between a first position and a second position; and a seat positioning mechanism coupled to the passenger seat that first operates while the vehicle is in the load/unload portion of the ride path to articulate the seat into the first position and second operates, prior to the vehicle traveling into the ride portion of the ride path, to articulate the seat into the second position, wherein the passenger seat includes a seat back for supporting a passenger's back, wherein the seat back is substantially vertical relative to horizontal in the first position and is at an obtuse angle relative to horizontal in the second position, and wherein the seat back is positioned with a passenger-receiving side facing a forward portion of the vehicle body, whereby a passenger has a point of view along a direction of travel of the vehicle when the seat back is in the first position.

2. The roller coaster of claim 1, wherein the ride portion comprises at least 90 percent of the length of the track and wherein the vehicle is supported above the track for at least one half of the ride portion, whereby a passenger positioned in the passenger seat has a line of sight that is generally upward when the vehicle is supported above the track.

3. The roller coaster of claim 1, wherein the seat back is positioned at an angle selected from the range of 90 to 110 degrees when in the first position and at an angle selected from the range of 120 to 180 degrees when in the second position.

4. The roller coaster of claim 3, wherein the angle selected for the second position of the seat back is between about 135 and 170 degrees and a passenger seated in the passenger seat has a line of sight that is upward.

5. The roller coaster of claim 1, wherein the passenger seat further including a seat pan, the seat pan being articulated concurrently between first and second positions associated with the first and second positions of the seat back.

6. The roller coaster of claim 5, wherein the seat pan is slid in a horizontal direction during the articulation of the passenger seat or is pivoted a different amount than the seat back during the articulation of the passenger seat.

7. The roller coaster of claim 1, further comprising a cam rail assembly along the track in the load/unload portion of the ride path and wherein the seat positioning mechanism includes a cam assembly contacting a contact surface of the cam rail assembly and translating the contacting to articulation of the seat back via a linkage assembly coupled to the seat back.

8. The roller coaster of claim 1, wherein the seat positioning mechanism comprises an electric motor or a linear actuator operated to articulate the seat back between the first and second positions while the vehicle is positioned in the load/unload portion of the ride path.

9. An amusement park ride with articulated seat backs, comprising;

a structural track;

a passenger vehicle riding on the structural track, wherein the structural track guides the passenger vehicle along a continuous closed loop path and the passenger vehicle is positioned above the structural track for at least a portion of the continuous closed loop path; and an articulated seat assembly including a seat mounted in the passenger vehicle for supporting a passenger in the passenger vehicle and a seat articulation mechanism repositioning at least a portion of the seat to position a back of the passenger in a substantially vertical position in a load and unload portion of the continuous closed loop path and in a reclined position in a ride portion of the continuous closed loop path, wherein a passenger seated in the seat faces a direction of travel of the vehicle and has a first line of sight that is along a direction of travel e vehicle with the seat in the substantially vertical position and a second line of sight that is traverse to the direction of travel with the seat in the reclined position.

10. The ride of claim 9, wherein the seat includes a seat back and a seat pan and wherein the seat articulation mechanism rotates the seat back and seat pan together between a load position in which the seat back is substantially vertical and a ride position in which the seat back is at an obtuse angle greater than about 120 degrees.

11. The ride of claim 10, wherein the seat back is positioned at an angle of 90 to 110 degrees measured from horizontal when in the load position and at an angle of 145 to 160 degrees when in the ride position.

12. The ride of claim 9, wherein the seat articulation mechanism comprises an actuator selectively actuating a linkage connected to the seat, the actuator and the linkage being configured to move the seat between a load position in which a seat back is substantially vertical and a ride position in which the seat back is at an obtuse angle.

13. The ride of claim 9, wherein the seat articulation mechanism comprises a passive linkage connected to the seat and wherein the passive linkage is actuated to rotate the seat between a load position and a ride position by a cam rail placed along the structural track in a station adapted for loading and unloading passengers.

14. A roller coaster, comprising:

a track;

a vehicle supported upon the track and adapted to roll along a path defined by the track;

a seat mounted to a frame of the vehicle, the seat comprising a seat pan and a seat back; and a seat positioning mechanism adapted for pivoting the seat back between a load position in which the seat back is substantially vertical and a ride position in which the seat back is at an angle greater than about 120 degrees from horizontal, wherein a passenger seated in the seat faces a direction of travel of the vehicle and has a first line of sight that is along a direction of travel of the vehicle with the seat in the load position and a second line of sight that is traverse to the direction of travel with the seat in the ride position.

15. The roller coaster of claim 14, wherein the angle of the seat back is at least about 145 degrees and wherein the seat positioning mechanism locks the seat back in the ride position for at least about one half of the length of the track.

16. The roller coaster of claim 14, wherein a body of the vehicle remains in an original orientation during the pivoting of the seat back.

17. The roller coaster of claim 14, wherein the seat pan is articulated separately from the seat back during the pivoting of the seat back.

18. The roller coaster of claim 17, wherein the articulation of the seat pan comprises sliding the seat pan in a plane transverse to a plane extending through the seat back.

19. The roller coaster of claim 14, wherein seat positioning mechanism comprises a passive linkage assembly mounted in the vehicle and coupled to seat back and wherein the roller coaster contacts a guide rail in a load and unload station that is positioned proximate to the track and contacts a portion of the linkage assembly to drive the articulation of the seat back into a position for loading or unloading of the passenger.

* * * * *

UNITED STATES PATENT AND TRADEMARK OFFICE

CERTIFICATE OF CORRECTION

PATENT NO. : 8,490,550 B2
APPLICATION NO. : 13/190624
DATED : July 23, 2013
INVENTOR(S) : David W. Crawford et al.

It is certified that error appears in the above-identified patent and that said Letters Patent is hereby corrected as shown below:

In the Claims:

Col. 12, line 28, claim 9, please replace claim 9 with the following rewritten claim --9. An amusement park ride with articulated seat backs, comprising:
a structural track;
a passenger vehicle riding on the structural track, wherein the structural track guides the passenger vehicle along a continuous closed loop path and the passenger vehicle is positioned above the structural track for at least a portion of the continuous closed loop path; and an articulated seat assembly including a seat mounted in the passenger vehicle for supporting a passenger in the passenger vehicle and a seat articulation mechanism repositioning at least a portion of the seat to position a back of the passenger in a substantially vertical position in a load and unload portion of the continuous closed loop path and in a reclined position in a ride portion of the continuous closed loop path, wherein a passenger seated in the seat faces a direction of travel of the vehicle and has a first line of sight that is along a direction of travel of the vehicle with the seat in the substantially vertical position and a second line of sight that is traverse to the direction of travel with the seat in the reclined position.--

Signed and Sealed this
Seventeenth Day of September, 2013

Teresa Stanek Rea

Teresa Stanek Rea
*Deputy Director of the United States Patent and Trademark Office*